United States Patent [19]

Mori et al.

[11] Patent Number: 4,904,544

[45] Date of Patent: Feb. 27, 1990

[54] ZN-BASED COMPOSITE-PLATED METALLIC MATERIAL AND PLATING METHOD

[75] Inventors: Kazuhiko Mori; Toshi Miyawaki, both of Hiratsuka, Japan

[73] Assignee: Nihon Parkerizing Co., Ltd., Tokyo, Japan

[21] Appl. No.: 226,483

[22] Filed: Aug. 1, 1988

Related U.S. Application Data

[63] Continuation-in-part of Ser. No. 151,662, Feb. 2, 1988, abandoned.

[30] Foreign Application Priority Data

Feb. 5, 1987 [JP] Japan ..... 62-23510
Nov. 12, 1987 [JP] Japan ..... 62-284248

[51] Int. Cl.[4] ..... C25D 3/24; C25D 3/56

[52] U.S. Cl. ..... 428/658; 204/44.2; 204/55.1; 428/659

[58] Field of Search ..... 204/44.2, 55.1; 428/658, 659

[56] References Cited

U.S. PATENT DOCUMENTS

| | | | |
|---|---|---|---|
| 2,451,426 | 10/1948 | Bair et al. | 204/44.2 X |
| 2,646,397 | 7/1953 | Wean | 204/44.2 |
| 3,070,521 | 12/1962 | Takada | 204/44.2 |
| 4,048,381 | 9/1977 | Adaniya et al. | 204/44.2 X |
| 4,064,320 | 12/1977 | Adaniya et al. | 204/44.2 X |
| 4,610,937 | 9/1986 | Ito et al. | 204/44.2 X |
| 4,659,631 | 4/1987 | Kurimoto et al. | 428/624 |
| 4,702,802 | 10/1987 | Umino et al. | 204/44.2 X |

FOREIGN PATENT DOCUMENTS

| | | |
|---|---|---|
| 16522 | 5/1972 | Japan . |
| 30649 | 10/1979 | Japan . |
| 23294 | 3/1981 | Japan . |
| 47588 | 4/1981 | Japan . |
| 210195 | 12/1983 | Japan . |
| 125395 | 7/1985 | Japan . |
| 2145739 | 4/1985 | United Kingdom . |
| 00045 | 1/1985 | World Int. Prop. O. . |

OTHER PUBLICATIONS

Japanese Patent Abstracts vol. 9, No. 283, Nov. 9, 1985, Kokai No. 60-128-283.

Japanese Patent Abstracts vol. 9, No. 278, Nov. 6, 1985, Kokai No. 60-125-395.

DD 236 760 A1, Page 1; Soviet Inventions Illustrated, section CH, week 8533, Sep. 25, 1985, SU-1135-816-A.

*Primary Examiner*—G. L. Kaplan

*Attorney, Agent, or Firm*—Armstrong, Nikaido, Marmelstein, Kubovcik & Murray

[57] ABSTRACT

Disclosed is a Zn-based composite-plated metallic material, comprising a plating layer on a metal substrate. The plating layer consists essentially of (1) Zn or as Zn alloy electroplated onto a metallic substrate and (2) the cathodic precipitation reaction product of aluminum, calcium, magnesium, strontium, titanium, zirconium, molybdenum, and/or tungsten. The latter metal constitutes 0.002 to 10% by weight of the plating layer. The cathodic precipitation-reaction product may be hydroxide, hydroxide hydrate or a phosphate.

14 Claims, No Drawings

ZN-BASED COMPOSITE-PLATED METALLIC MATERIAL AND PLATING METHOD

This is a continuation-in-part application of U.S. Ser. No. 151,662, filed 2/2/88, abandoned.

BACKGROUND OF INVENTION

1. Field of Invention

The present invention relates to a Zn-based composite-plated metallic material exhibiting improved, corrosion-resistance and other properties and to a composite plating method. The present invention relates to mainly steel materials plated with Zn or Zn alloy. Specifically, the present invention relates to a Zn-electroplated steel sheet exhibiting improved, corrosion-resistance, paint-adherence, formability, and other properties, as well as a method for producing said steel sheet.

2. Description of Related Arts

The Zn-electroplating is mainly carried out as the rust-proofing plating of steel sheets and has been broadly used in the field of automobiles, household appliances, and the like, by utilizing the sacrificing (galvanizing) anode effect of the Zn coating on the Zn-plated steel sheet. Advantageously, the Zn electroplating is superior to the other plating methods, such as hot-dip galvanizing, in uniformity, formability, smoothness, and the like of coating and enables thin deposition. Nevertheless, along with demands for further improving the corrosion resistance and the other properties centered recently on automobile bodies have been enhanced, it became more important to develop Zn-based electrolytic plating having further higher properties than the pure Zn plating.

The technical developments, which have been made in the field of plating so as to meet the above demands and to improve such surface properties as the corrosion-resistance and paint-adherence of Zn-electroplated steel sheets are roughly classified into two methods. One of them is already broadly employed for a composite electroplating, and resides in alloy-plating by means of a plating bath, in which such metallic ions as Sn, Pb, Ni, Mo, Mn, Fe, Cu, Co, Cd, and the like capable of codepositing with Zn are incorporated. The other is a dispersion-plating method with the use of additives of organic resin or inorganic material. As the inorganic materials used, fine particles of compounds insoluble to the bath, such as alumina, silica, and the like are suspended and dispersed in the bath.

Since, in the ordinary Zn-plated steel sheets, the potential difference between the constituent Zn of plating layer and the Fe as the substrate material is great, the sacrificing anode-effect of the plating layer is excellent. This fact, however, makes it necessary to form an extremely thick plating layer for the purpose of rust-proofing over a long period of time, because the dissolution rate of Zn-plating layer is rapid. The Zn-alloy plating method of Ni, Co, Fe, and the like is presently used to cope with the above described problems, and is based on the concept that the potential difference between the substrate material and plating layer is appropriately controlled by means of depositing, together with Zn, a metal which is electrochemically more noble than Zn, thereby adjusting the sacrificing anode-current (galvanic current) within an appropriate range and hence controlling the corrosion rate of plating layer as low as possible.

The presently used, Zn-alloy plating method intends therefore to attain mainly the electrochemical, sacrificing corrosion-proofing. Therefore, the Zn-based alloy plating allegedly exhibits a corrosion-resistance over a longer period of time compared with the ordinary Zn-plated steel sheet, using the identical deposition amounts. Nevertheless, the Zn-based alloy plating involves a limitation in improvement of the corrosion resistance, since a too high content of noble metal incurs a decrease in the sacrificing anode effect, pitting corrosion is liable to occur. In addition, a uniform dissolution of the respective elements of the plating layer is a premise for realizing the excellent corrosion resistance of the Zn-based alloy. Actually, however, a preferential dissolution of Zn, which is potentially less noble, occurs, with the result that the proportion of noble metal(s) to less noble metal(s) of the plating layer increases, and finally the potential of the plating layer arrives that of noble metal(s). In this case, the galvanic corrosion-proofing of the iron of substrate is lost. This is presumably a reason for the pitting corrosion described above.

In the dispersion plating method, the fine particles of silica, titanium oxide, and the like are dispersed in the liquid body and are incorporated in the plating layer, thereby lessening the electric conductivity and hence suppressing the corrosion speed of a plating layer to the level as low as possible. This technique involves a difficulty in effectively incorporating the fine particles in the plating layer. In addition, since the fine particles used must be chemically inactive so as to prevent dissolution thereof in the plating liquid, the effects of composite particles are principally attributable to physical protection, alone. This provides a limitation in improvement of the corrosion resistance.

Incidentally, Al is not capable of co-depositing with Zn (c.f. Iron and Steel Handbook, 3rd Edition, Volume VI, page 419, FIGS. 10,27). However, according to a known technique for providing a Zn-Al composite, electroplated steel sheet, the form of Al in the plating bath is modified to a special one so as to co-deposit the same together with Zn. The metallic Al particles, which are dispersed in a plating layer, have a property of being liable to dissolve during the corrosion. This property is utilized to chemically and electrochemically enhance rust proofing. More specifically, in Japanese Examined Patent Publication No. 54-30649, a technique for forming a Zn-Al composite electroplating containing 1.5 to 70% by weight of the dispersed Al, by means of stirring the Zn plating bath, in which the Al powder is suspended is disclosed. The technique described in this publication has common characteristics of alloy plating and dispersion plating. The structure of obtained plating is however so prominent that Al is enriched and segregated in the top surface side of a Zn-Al composite electroplated layer, and such Al allegedly improves the corrosion-resistance according to the description of publication.

In addition, according to Japanese Unexamined Patent Publication No. 60-125,395, there is a technique disclosed for forming a Zn-alumina series composite plating containing, in terms of $Al_2O_3$, from 0.01 to 3% by weight of aluminum compound, which is soluble to dilute hydrochloric acid, by use of the plating bath, in which positively charged alumina sol is added.

As is described above, the alloy plating method involves a tendency that the galvanic corrosion-protection by Zn is weakened by the alloyed noble metal. The mere alloying of a plating layer therefore involves a limitation in the improvement of corrosion resistance.

In the dispersion plating of fine particles, the fine particles 5 mμ to 50 mμ in diameter are positively charged by means of a cationic surfactant agent and move toward the surface of a cathode due to electrophoresis, and deposit on the electrode surface while losing the charges. The fine particles may have positive charges due to the inherent characteristics thereof. The deposits on the electrode surface are merely physically adsorbed due to the Van der Waals force with respect to the electrode surface. Contrary to this, the bonding between the deposited plating metal and the constituent metal of an electrode is a metallic bond. Accordingly, the fine particles can easily separate from the electrode surface, until such a deposition state of matrix metal that the fine particles are embedded therein at a half or more of the diameter of fine particles. The drawbacks of the conventional dispersion plating method are therefore as follows.

(1) The co-depositing plating is not obtained at a plating thickness of ½ or less relative to the diameter of co-deposited particles.

(2) Since the separation possibility of co-depositing particles from the plated surface is high during the plating process, a high co-deposition degree is not obtained. In order to obtain a certain co-deposition degree, the content of co-depositing components in the bath must be raised exceedingly.

(3) Under the conditions of a high speed-plating (plating at a high current density), vigorous stirring becomes necessary. This incurs a decrease of the co-deposition degree.

(4) With the increase in the particle diameter, the influence of gravity appears, such that, for example in the plating using horizontal electrodes, the co-deposition degree in the lower side is lower than that in the upper side of a workpiece.

(5) The solid matter included in the bath makes it difficult to maintain the uniformity of bath components and to maintain the devices.

SUMMARY OF INVENTION

It is an object of the present invention to develop a novel technique for composite Zn-electroplating: which principally does not have the drawbacks of conventional Zn-plating technique; which is suitable for production of Zn-plated steel sheets in which production a high speed plating is essential; and, which provides a composite plated metallic material exhibiting improved, corrosion-resistance and paintability.

The present inventors developed a heretofore unknown, composite plating method: in which metallic Zn is applied, by eletroplating, on the surface of metallic material to form a film; such metallic compound as hydroxide and phosphates is dispersed and co-deposited in the plating layer at the same time as the Zn-plating; and, the insoluble composite particles are not added to the bath.

In the present invention, the presence of solid matter in the plating bath is unnecessary, the composite components of composite plating are present in the bath in the form of ions, such as $Al^{+++}$, and, hydroxide and phosphates deposit in accordance with the rise of pH due to discharge of $H^+$ at the cathode. This deposition reaction occurs only in an extremely thin diffusion layer on the electrode surface, that is, the electrode interface. The hydrogen bonding of water adsorbed on the electrode surface as well as the electric attractive force between the undischarged aluminum ions and the electrode surface are intermediary for bonding the deposited hydroxide, phosphate and the like, with respect to the electrode surface. This provides a stronger bonding than merely physical bonding. It is therefore understood that the separation possibility of deposits under physical external force, such as stirring, becomes considerablylow. The present invention is therfore principally free of the drawbacks (1) through (5) of the conventional dispersion plating. The superiority of the present invention over the conventional dispersion plating is particularly high in the case of applying the present invention to the production of Zn-plated steel sheets, in which a high speed plating is essential.

The Zn-based composite plated metallic material according to the present invention comprises: a metallic material substrate; and, a plating layer applied on the metallic material-substrate and consisting essentially of aluminum, calcium, magnesium, strontium, zirconium, chromium, molybdenum, and tungsten, said metal being in an amount of from 0.002 to 10% by weight in terms of the metal, wherein the reaction product is a hydroxide, a hydroxide hydrate, or phosphate.

If the content of metallic compound described in detail hereinbelow is less than 0.002% by weight, the composite plating is ineffective. On the other hand, if the content of metallic compound is more than 10% by weight, there is a danger that Zn is not applied by plating.

The compound, which is the composite member of a plating layer, is composed by a cathodic precipitation reaction. This is an outstanding feature according to the present invention and is described hereinafter.

The pH of plating bath, which contains aluminum ions, is adjusted to or slightly less than an equilibrium pH of $Al(OH)_3$-precipitation. The steel sheet as a plating object is electrolyzed in such plating bath, so that the aluminum ions move to the cathode surface due to the potential between the anode and cathode. When the pH on the cathode surface rises, the aluminum ions react with $OH^-$, to yield $Al(OH)_3$ or $Al(CO)_3.nH_2O$. The particles of $Al(OH)_3$ or $Al(OH)_3.nH_2O$ are included in the Zn plated film formed. The components of the bath are presumably adsorbed somewhat on the $Al(OH)_3.nH_2O$ particles.

An oxidizer is contained in the bath, when one or more metals other than aluminum are codeposited with Zn. An oxidizer may or may not be contained in the bath, when the aluminum is codeposited with Zn. When aluminum and metal(s) other than aluminum are codeposited with Zn, the oxidizer is contained in the bath. Under the presence of an oxidizer, the film formation occurs in the same process as the case of aluminum as described above, except that the pH rise at the interface of cathode during electrolysis occurs mainly due to the consumption of $H^+$ by its reaction with oxidizer and hence yielding of $OH^-$. Accordingly, the simultaneous reactions of film formation occurs in parallel: (1) deposition reaction of metallic Zn, (2) consumption of $H^+$ at the interface of cathode, and (3) deposition reaction of composite particles.

(1) Deposition Reaction of Metallic Zn $$Zn^{2+} + 2e^- \rightarrow Zn$$

(2) Consumption of $H^+$ at Interface of Cathode $$2H^+ + 2e^- \rightarrow H_2\uparrow$$

$$9H^+ + NO_3^- + 8e^- \rightarrow 3H_2O + NH_3$$

(In the case of adding $NO_3$)

$$2H^+ + H_2O_2 + 2e^- \rightarrow 2H_2O$$

(In the case of adding $H_2O_2$)

(3) Deposition Reaction of Composite Particles $$Al^3 + 3OH^- \rightarrow Al(OH)_3$$

$$Ca^{2+} + 2OH^- \rightarrow Ca(OH)_2$$

$$Mg^{2+} + 2OH^- \rightarrow Mg(OH)_2$$

$$Sr^{2+} + 2OH^- \rightarrow Sr(OH)_2$$

$$Ti^{4+} + 4OH^- \rightarrow Ti(OH)_4$$

$$Zr^{4+} + 4OH^- \rightarrow Zr(OH)_4$$

$$Mo^{6+} + 5OH^- + e^- \rightarrow Mo(OH)_5$$

$$W^{6+} + 5OH^- + e^- \rightarrow W(OH)_5$$

The reaction (1) is a reduction and deposition of $Zn^{2+}$ and is the principal reaction. This reaction proceeds in the same manner as in the ordinary Zn plating. However, in parallel with this reaction, the oxidizer reacts electrochemically at the cathode interface as in (2), to incur the pH rise at the cathode interface during the electrolysis. Along with this, the reaction (3) proceeds to form a composite film. The composite deposition of aluminum is further promoted by an oxidizer.

In the case of using phosphate, the composite deposition of zinc phosphate occurs by the reaction of $$3Zn(H_2PO_4)_2 \rightarrow Zn_3(PO_4)_2 + 4H_3PO_4$$

In addition, such reactions as $Al^{3+} + PO_4^{3} \rightarrow AlPO_4$ and $Cr^{3+} + PO_4^{3+} \rightarrow CrPO_4$ occur.

As the oxidizer, the oxyacid such as $NO_3^-$, $NO_2^-$ and $SeO_3^-$. and the halogen acid such as $BrO_3^-$, $IO_3^-$ and $ClO_3^-$ can be used. $NO_3^-$ is preferred in the light of stability, i.e., non-decomposition in the bath, and reactivity, i.e., attainment of desired quantity of co-deposition by a small amount. The particular form of these oxyacid and halogen acid to be added into the bath is acid, metallic salt, or ammonium salt.

In addition, as the oxidizer, peroxide, such as $H_2O_2$, hydrogen peroxide-aduct, such as $Na_2SiO_3.H_2O_2.H_2$ or $NaBO_2.H_2O_2.H_2O$, and metallic peroxide such as $MgO_2$ and $CaO_2$ can be used. The above oxidizing compounds can be used alone or in combination of optionally selected two or more. Furthermore, it is possible to use oxyacid, peroxide, hydrogen peroxide aduct and metallic peroxide other than the above described ones, provided that they realize the desired effects.

The characterizing structure of the Al-composite plating film according to the present invention is hereinafter described. The structure of this film is that very fine gel particles of aluminum hydroxide and the like are included in the Zn plated layer as the composite member. When this film is subjected to thorough natural drying, heating or reduced pressure so as to dry the same, the product particles of cathodic precipitation reaction undergo a dehydration, thereby incurring such a gradual change of compound that the "n" of $Al(OH)_3.nH_2O$ decreases or $Al(OH)_3$ is converted to $Al_2O_3$. Along with such change, the product particles of cathodic precipitation reaction shrinks, and the hydration-water and the chemically or physically adsorbed water vaporize, with the consequence that a number of minute pores are formed in the alumina gel-particles which are included in the Zn-plating layer. Such structure of composite plated layer according to the present invention is one factor for improving the corrosion resistance.

The reasons for the corrosion-resistance improvement are considered as follows.

(a) The alumina gel in the film absorbs the water and then forms a protective coating.

(b) When alumina, once calcined at a high temperature, is dispersed in the plating layer, a problem appears in that the alumina slowly dissolves in the acid. Contrary to this, aluminum compound, which deposits by the cathodic precipitation reaction of aluminum ions according to the present invention, is alumina gel which has the properties of extremely easily dissolving in acid and alkali, and, therefore, the $Al^{3+}$ redissolved realizes the effect that it immediately suppresses a conversion reaction of $Zn(OH)_2$ formed as a result of Zn-corrosion to conductive ZnO.

(c) In the conventional, simple Zn plating, $Zn^{2+}$ dissolved by the sacrificing anode effect does not form a protective coating but is liable to move externally and disappear. When the pores are formed in the plating layer by drying in accordance with the present invention, the $Zn^{2+}$ are trapped in the minute pores to form a protective coating.

The Zn-Al compound composite plating layer is porous and has a large effective surface area. By utilizing this property, the post-treatment with the use of organic or inorganic sealant can be carried out, to further enhance the properties. The present invention is therefore suitable also for the production of surface-treated steel sheets and paint-coated steel sheets having a high corrosion-resistance. The applications, in which the other functional properties are utilized, are broad, such as black plating for exterior coating and impregnatiion of lubricant oil, press oil, and the like for producing the heavily worked steel sheets or for surface treatment for cold-working.

The method for composite plating according to the present invention is hereinafter described with reference to an example.

The Zn-sulfate or chloride bath, and the ordinarily used acidic Zn bath can be used as the Zn-plating bath. The Zn-plating bath contains $Zn^{2+}$ preferably from 2 to 150 g/l.

The concentration of metallic ions, such as aluminum, chromium, calcium, and the like is in at least such quantity that the desired improvement of corrosion resistance can be attained. This concentration is at the highest below such quantity that the metallic ions tend to precipitate as the hydroxide and the like, or gel material tends to form to suppress the precipitation of Zn. A preferable concentration within this lowest and highest quantity depends on pH but is, for example, from 0.01 to 50 g/l for $Al^{3+}$, $Ca^{2+}$, $Cr^{3+}$, $Mg^{2+}$, and $Sr^{2+}$, and from 0.1 to 20 g/l for $W^{6+}$, $Mo^{6+}$, $Ti^{4+}$, and $Zr^{4+}$.

The forms of metallic ions, such as aluminum ions, suitable for adding into the plating bath are nitrate, chloride, sulfate, and the other soluble metallic salt.

Alternatively, the metallic powder may be added to and dissolved in the bath, or the Zn-Al alloy or the like may be used for the anode.

The ionic valency of metal ions to be codeposited with Zn should be such that; they are stable in the bath, i.e., they are neither oxidized nor reduced in the plating bath to form precipitates, which are then charged and deposited on the cathode; and, the precipitation of metal compounds occur not in the body of plating bath but interface of a cathode due to the cathodic precipitation reaction as described by the formulas (1), (2), and (3) mentioned above. The above described valencies of $Al^{3+}$, $Ca^{2+}$, $Cr^{3+}$, $Mg^{2+}$, $Sr^{2+}$, $W^{6+}$, $Mo^{6+}$, $Ti^{4+}$, and $Zr^{4+}$ ions satisfy the stability and provide a requirement of the cathodic precipitation reaction. When the quantity of oxidizer is too small, its effect is not attained. On the other hand, when the quantity of oxidizer is too large,, the film adherence is impaired. The quantity of oxidizer is therefore to be appropriately determined, depending upon kinds thereof, so as not to incur the above described detrimental phenomena.

The pH of usable plating bath is in the range of from 1.5 to 5.5. The pH, at which the precipitation of $Al(OH)_3$ occurs varies depending upon the additional quantity of aluminum ions and the like and the presence or absence of other additives. A desirable pH therefore varies accordingly. The additives, which are used in the ordinary Zn plating bath for the purpose of pH-stabilization and conductivity enhancement, may also be used as heretofore.

Boric acid, ammonium chloride, citric acid, fluorides, $Na_2SO_4$, and the like may be added.

In the foregoing descriptions, the plating is described for the ordinary pure Zn plating. However, it is likewise possible to carry out a composite plating of Zn based alloy and metallic compound. In the case of not using the oxidizer, various metallic ions such as Ti, Zr, Co, Mn, Ni, Ca, Mg, Cr, and the like are added to the bath and then deposit in a metallic state together with Zn. When the oxidizer is used, the metallic ions having the claimed valency co-deposit in the form of a compound, such as hydroxide. The metallic ions having the other valencies deposit in a metallic state. Fe, Ni, and Co deposit in a metallic state irrespective of the valency.

The present invention is described in detail by way of examples.

Cold-rolled sheets (SPCC) were subjected to the pre-treatment by alkali-degreasing. The cold-rolled sheets were pickled by 5% $H_2SO_4$, followed by water-rinsing. In the plating, the plating liquid body was stirred by means of air-blowing with the use of an air-pump. The anode used was a pure Zn sheet, while the cathode used was a test sheet (a cold-rolled sheet). In the electrolysis, the liquid temperature was 50° C., the current density was 20A/dm$^2$, the conduction time was 30 seconds and the Zn concentration was 20 g/l.

In Examples 1 through 4, the composite deposition of aluminum in the Zn matrix was tested.

| | |
|---|---|
| Comparative Example 1 | |
| Bath Composition | |
| Zinc sulfate heptahydrate | 200 g/l |
| Sodium sulfate | 100 g/l |
| Sulfuric acid | 4 g/l |
| pH 3 | |
| Example 1 | |
| Bath Composition | |
| Zinc sulfate heptahydrate | 200 g/l |

-continued

| | |
|---|---|
| Sodium sulfate | 100 g/l |
| Aluminum nitrate enneahydrates | 1-100 g/l |
| Sulfuric acid | 4 g/l |
| pH 3 | |
| Example 2 | |
| Bath Composition | |
| Zinc sulfate heptahydrate | 200 g/l |
| Sodium sulfate | 100 g/l |
| Aluminum nitrate enneahydrate | 3-100 g/l |
| Sulfuric acid | 25 g/l |
| pH 1.8 | |
| Example 3 | |
| Bath Composition | |
| Zinc chloride | 150 g/l |
| Sodium chloride | 50 g/l |
| Aluminum chloride | 0.5-10 g/l |
| Hydrogenborofluoride | 5 g/l |
| pH 2.8 | |

The examination of properties was carried out as follows.

(1) SEM was used to investigate the presence or absence of pores so as to determine the film structure.

(2) The corrosion resistance (unpainted) was investigated by the salt spray test (JIS Z2371) and the results are shown by the time until generation of red rust.

(3) The corrosion resistance (E.D. sheet) was investigated by applying a 15 μm thick coating of cation electrodeposition paint (produced by Kansai Paint), then forming cross cuts on the paint coating, and subjecting the sheets to a salt spray test for 480 hours. The results are shown by the width of blister at the cut parts (maximum width at one side).

| | |
|---|---|
| 4 | 0~1 mm |
| 3 | 1~3 mm |
| 2 | 3~6 mm |
| 1 | 6 mm or more |

In addition to the above (1), the determination of film structure was carried out by the method for measuring a bulk specific gravity, which indicates the proportion of pores. The bulk specific gravity obtained was from 2 to 6.9. The specific gravity was measured by the method of; dipping a sample in 7% HCl solution for 3 minutes; measuring the weight before and after the immersion to obtain the plated weight (g/m$^2$); obtaining a film thickness (μm) by an electromagnetic film-thickness tester; and, dividing the film weight by film thickness.

The results obtained are shown in Table 1.

TABLE 1

| Run No. | Plating Bath | pH of Bath | $Al^{3+}$ in bath (g/l) | $Al^{3+}$ in film (%) | Film structure | Corrosion Resistance Unpainted (hrs) | Corrosion Resistance Cation E.D. |
|---|---|---|---|---|---|---|---|
| 1 | Comparative example | 3.0 | 0 | 0 | no | 20 | 1 |
| 2 | Example 1 | 3.0 | 0.01 | 0.01 | no | 24 | 1 |
| 3 | Example 1 | 3.0 | 0.05 | 0.02 | yes | 48 | 3 |
| 4 | Example 1 | 3.0 | 0.2 | 0.5 | yes | 96 | 4 |
| 5 | Example 1 | 3.0 | 1.0 | 3 | yes | 120 | 4 |
| 6 | Example 1 | 3.0 | 10 | 8 | yes | 120 | 3 |

TABLE 1-continued

| Run No. | Plating Bath | pH of Bath | $Al^{3+}$ in bath (g/l) | $Al^{3+}$ in film (%) | Film structure | Corrosion Resistance Unpainted (hrs) | Corrosion Resistance Cation E.D. |
|---|---|---|---|---|---|---|---|
| 7 | Example 2 | 1.8 | 0.05 | 0.01 | no | 24 | 1 |
| 8 | Example 2 | 1.8 | 0.2 | 0.01 | yes | 36 | 2 |
| 9 | Example 2 | 1.8 | 1.0 | 0.5 | yes | 48 | 3 |
| 10 | Example 2 | 1.8 | 10 | 2.5 | yes | 48 | 3 |
| 11 | Example 3 | 2.8 | 0.2 | 0.1 | yes | 120 | 4 |

In the following described Comparative Example 2 and Examples 4 through 8 the deposition of metallic compound was tested with the use of an oxidizer.

| | |
|---|---|
| Comparative Example 2 | |
| Bath Composition | |
| Zinc sulfate heptahydrates | 200 g/l |
| Sodium sulfate | 100 g/l |
| Sulfuric acid | 4 g/l |
| Comparative Example 3 | |
| Bath Composition | |
| Zinc sulfate heptahydrates | 200 g/l |
| Nickel sulfate hexahydrates | 100 g/l |
| Sodium sulfate | 100 g/l |
| Sulfuric acid | 4 g/l |
| Example 4 | |
| Bath Composition | |
| Zinc sulfate heptahydrates | 200 g/l |
| Sodium sulfate | 50 g/l |
| Sodium nitrate | 0.5 g/l |
| Aluminum hydroxide | 2.9 g/l |
| Sulfuric acid | 4 g/l |
| pH 3 | |
| Example 4 | |
| Bath Composition | |
| Zinc sulfate heptahydrates | 200 g/l |
| Sodium sulfate | 50 g/l |
| Sodium nitrate | 0.5 g/l |
| Aluminum hydroxide | 2.9 g/l |
| Sulfuric acid | 4 g/l |
| pH 3 | |
| Example 5 | |
| Bath Composition | |
| Zinc sulfate heptahydrates | 200 g/l |
| Sodium sulfate | 50 g/l |
| Sodium nitrate | 1.0 g/l |
| Chromium sulfate | 12 g/l |
| Sulfuric acid | 3 g/l |
| Example 6 | |
| Bath Composition | |
| Zinc sulfate heptahydrates | 200 g/l |
| Sodium bromate | 0.1 g/l |
| Aluminum hydroxide | 5.8 g/l |
| Sulfuric acid | 5 g/l |
| Example 7 | |
| Bath Composition | |
| Zinc sulfate heptahydrates | 200 g/l |
| Potassium iodate | 0.2 g/l |
| Cobalt sulfate heptahydrate | 30 g/l |
| Sulfuric acid | 5 g/l |
| Magnesium sulfate | 10 g/l |
| Example 8 | |
| Bath Composition | |
| Zinc sulfate heptahydrates | 200 g/l |
| Nickel sulfate heptahydrates | 134 g/l |
| Hydrogen peroxide | 0.2 g/l |
| Sulfuric acid | 2 g/l |
| Aluminum hydroxide | 2.9 g/l |
| Example 9 | |
| Bath Composition | |

-continued

| | |
|---|---|
| Zinc sulfate heptahydrates | 200 g/l |
| Sodium nitrate | 0.5 g/l |
| Aluminum hydroxide | 2.9 g/l |
| Strontium nitrate | 1.1 g/l |
| Sulfuric acid | 3 g/l |
| Example 10 | |
| Bath Composition | |
| Zinc sulfate heptahydrates | 200 g/l |
| Calcium nitrate | 1 g/l |
| Sodium sulfate | 30 g/l |
| Sulfuric acid | 2 g/l |
| Example 11 | |
| Bath Composition | |
| Zinc sulfate heptahydrates | 200 g/l |
| 20 wt % zirconium sulfate-solution | 3 g/l |
| Aluminum hydroxide | 1.5 g/l |
| Sulfuric acid | 6 g/l |
| Sodium nitrate | 2 g/l |
| Example 12 | |
| Bath Composition | |
| Zinc sulfate heptahydrates | 200 g/l |
| Aluminum hydroxide | 1.5 g/l |
| Ammonium tungstate pentahydrates | 0.7 g/l |
| Ammonium nitrate | 0.8 g/l |
| Sulfuric acid | 3 g/l |
| Example 13 | |
| Bath Composition | |
| Zinc sulfate heptahydrates | 200 g/l |
| Aluminum hydroxide | 1.5 g/l |
| Ammonium molybdate pentahydrates | 1.25 g/l |
| Sodium nitrate | 0.8 g/l |
| Sulfuric acid | 3 g/l |
| Example 14 | |
| Bath Composition | |
| Zinc sulfate heptahydrates | 200 g/l |
| 20 wt % titanium sulfate solution | 3 g/l |
| Aluminum hydroxide | 1.5 g/l |
| Sulfuric acid | 6 g/l |
| Sodium nitrate | 2 g/l |

The corrosion-resistance measured by the same method as in Table 1 is shown in Table 2.

In the following described Examples 4 through 14, the deposition of metallic compound was tested with the use of an oxidizer.

TABLE 2

| Run No. | Oxidizing agent (ppm) | Alloying elements (ion conc) | Codepositing element (ion conc) | Corrosion resistance Unpainted (hours) | Corrosion resistance Cation E.D. |
|---|---|---|---|---|---|
| Ex. 4 | $NaNO_3$ (500) | no | $Al^{3+}$ 1 g/l | 180 | 4 |
| Ex. 5 | $NaNO_3$ (1000) | no | $Cr^{3+}$ 3 g/l | 70 | 3 |
| Ex. 6 | $NaBrO_3$ (200) | no | $Al^{3+}$ 2 g/l | 100 | 4 |
| Ex. 7 | $KIO_3$ (200) | $Co^{2+}$ 6 g/l | $Mg^{2+}$ 2 g/l | 130 | 4 |
| Ex. 8 | $H_2O_2$ (200) | $Ni^{2+}$ 30 g/l | $Al^{3+}$ 1 g/l | 200 | 4 |
| Ex. 9 | $NaNO_3$ (1000) | no | $Al^{3+}$ 1 g/l<br>$Sr^{2+}$ 0.5 g/l | 200 | 4 |
| Ex. 10 | ↑ | no | $Ca^{2+}$ 0.3 g/l | 140 | 4 |
| Ex. 11 | ↑ | no | $Zr^{4+}$ 0.2 g/l<br>$Al^{3+}$ 0.5 g/l | 150 | 4 |
| Ex. 12 | ↑ | no | $W^{6+}$ 0.5 g/l<br>$Al^{3+}$ 0.5 g/l | 180 | 4 |
| Ex. 13 | ↑ | no | $Mo^{6+}$ 0.5 g/l<br>$Al^{3+}$ 0.5 g/l | 180 | 4 |
| Ex. 14 | ↑ | no | $Ti^{4+}$ 0.05 g/l<br>$Al^{3+}$ 1 g/l | 250 | 4 |
| C. Ex. 2 | no | no | no | 20 | 1 |
| C. Ex. | no | $Ni^{2+}$ | no | 70 | 3 |

TABLE 2-continued

| Run No. | Oxidizing agent (ppm) | Alloying elements (ion conc) | Codepositing element (ion conc) | Corrosion resistance | |
|---|---|---|---|---|---|
| | | | | Unpainted (hours) | Cation E.D. |
| 3 | | 56 g/l | | | |

Remarks:
Ex. = Example
C. Ex. = Comparative Example

We claim:

1. A method for plating a Zn-based composite-plated metallic material on a metallic substrate, comprising:

preparing a plating solution containing Zn ions and titanium ions which are only in the form of tetravalent $Ti^{4+}$ and an oxidizer selected from the group consisting of hydrogen peroxide, oxyacid of nitrogen and oxyacid of halogen;

bringing said metallic material as a cathode into contact with said plating solution;

adjusting the pH of said plating solution to such a value that the tetravalent $Ti^{4+}$ is maintained dissolved in the body of the plating solution;

raising pH in the vicinity of the cathode in the presence of said oxidizer;

precipitating said tetravalent $Ti^{4+}$ ions in said vicinity of said cathode; and, electrodepositing a plating layer which consists essentially of Zn or Zn alloy and a hydroxide, hydroxide hydrate or phosphate of titanium.

2. The product of the process of claim 1.

3. The method according to claim 1, wherein said plating solution contains ions of at least one metal selected from the group of Fe, Ni and Co, which metal is co-deposited in metallic form as an alloy element.

4. The product of the process of claim 3.

5. A method for plating a Zn-based composite-plated metallic material on a metallic material substrate, comprising:

preparing a plating solution containing Zn ions, aluminum ions which are only in the form of trivalent $Al^{3+}$, and an oxidizer selected from the group consisting of hydrogen peroxide, oxyacid of nitrogen and oxyacid of halogen;

bringing said metallic material as a cathode into contact with said plating solution;

adjusting pH of said plating solution to such a value that the trivalent $Al^{3+}$ is maintained dissolved in the body of the plating solution;

raising pH in the vicinity of the cathode;

precipitating said trivalent $Al^{3+}$ ions in said vicinity of said cathode; and, electrodepositing a plating layer which consists essentially of Zn or Zn alloy and a hydroxide, hydroxide hydrate or phosphate of aluminum.

6. The product of the process of claim 5.

7. A method according to claim 5, wherein the content of aluminum ions in the plating solution is from 0.01 to 20 g/l.

8. The product of the process of claim 7.

9. A method according to claim 5 or 7, wherein said plating solution contains ions of at least one metal selected from the group of Fe, Ni and Co, which metal is co-deposited in metallic form as an alloy element.

10. The product of the process of claim 9.

11. A method for plating a Zn-based composite-plated metallic material on a metallic material substrate, comprising:

preparing a plating solution containing Zn ions, at least one element selected from the group consisting of $Ca^{2+}$, $Mg^{2+}$, $Sr^{2+}$, $Zr^{4+}$, $Cr^{3+}$, $Mo^{3+}$, and $W^{6+}$ ions, and an oxidizer selected from the group consisting of a hydrogen peroxide, an oxyacid of nitrogen and an oxyacid of halogen;

bringing said metallic material as a cathode into contact with said plating solution;

adjusting pH of said plating solution to such a value that said ions are maintained dissolved in the body of the plating solution;

precipitating ions of said at least one element in said vicinity of said cathode; and electrodepositing a plating layer which consists essentially of Zn or Zn alloy and a hydroxide, hydroxide hydrate or phosphate of said at least one element.

12. The product of the process of claim 11.

13. A method according to claim 11, wherein said plating solution contains ions of at least one metal selected from the group of Fe, Ni and Co, which metal is codeposited in metallic form as an alloy element.

14. The product of the process of claim 13.

* * * * *